US007066212B2

(12) United States Patent
Berger et al.

(10) Patent No.: US 7,066,212 B2
(45) Date of Patent: Jun. 27, 2006

(54) METHOD FOR PRODUCING A WOVEN AND A HEDDLE PARTICULARLY FOR USE THEREBY

(75) Inventors: Johann Berger, Alfdorf (DE); Siegfried Hahn, Traun (AT)

(73) Assignee: Berger GmbH & Holding KG, Maulburg (DE)

( * ) Notice: Subject to any disclaimer, the term of this patent is extended or adjusted under 35 U.S.C. 154(b) by 0 days.

(21) Appl. No.: 11/217,117

(22) Filed: Aug. 31, 2005

(65) Prior Publication Data

US 2006/0054236 A1 Mar. 16, 2006

Related U.S. Application Data

(63) Continuation of application No. PCT/EP2004/001764, filed on Feb. 23, 2004.

(30) Foreign Application Priority Data

Mar. 3, 2003 (DE) ..... 103 09 260

(51) Int. Cl.
*D03C 13/00* (2006.01)

(52) U.S. Cl. ..... 139/55.1; 139/59; 139/48; 139/11

(58) Field of Classification Search ..... 139/11, 139/48, 55.1, 59, 52, 53, 93
See application file for complete search history.

(56) References Cited

U.S. PATENT DOCUMENTS 1,517,129 A * 11/1924 Ruegg, Jr. ..... 139/93
2,132,245 A 10/1938 Royle
2,461,497 A * 2/1949 Kaufmann ..... 139/92
2,541,745 A * 2/1951 Carragher ..... 139/51
2,690,771 A * 10/1954 Consoletti ..... 139/96
3,640,314 A * 2/1972 Strauss ..... 139/436

(Continued)

FOREIGN PATENT DOCUMENTS

DE 1 292 597 4/1969

(Continued)

*Primary Examiner*—John J. Calvert
*Assistant Examiner*—Robert H Muromoto
(74) *Attorney, Agent, or Firm*—Harness, Dickey & Pierce, P.L.C.

(57) ABSTRACT

A method for producing tissue with the aid of a weaving loom comprising a stop bar, at least one shed and a heddle for carrying out the method. The inventive method is characterized in that warp thread guiding a filling yarn cooperates with a longitudinal heddle connected to the filling yarn and is arranged between the filling yarn and the stop bar of the weaving loom. The warp thread passes through the filling yarn and a longitudinal heddle controlled by a Jacquard device which carries out normal yarn up-and-down movement (down-and-up). Two superposed wefts which are arranged below and under the shed are simultaneously inserted therein. In order to produce a visible section of the filling yarn above a tissue layer (pattern) during the descending (ascending) movement of the filling yarn, the longitudinal heddle is displaced in an ascending (descending) position by the Jacquard device in such a way that the longitudinal heddle provided with a corresponding eye whose lower (top) end is in the center of the shed (central position) prevents the warp thread guided by the filling yarn from moving downward (upward) beyond the shed center, and the lower (top) weft is located outside the shed is inserted.

4 Claims, 5 Drawing Sheets

U.S. PATENT DOCUMENTS

| | | | | |
|---|---|---|---|---|
| 4,572,241 | A * | 2/1986 | Kramer | 139/52 |
| 4,790,357 | A * | 12/1988 | Kramer | 139/91 |
| 5,183,081 | A * | 2/1993 | Kuster et al. | 139/59 |
| 6,866,068 | B1 | 3/2005 | Berger et al. | |
| 6,918,410 | B1 | 7/2005 | Berger | |
| 2003/0166367 | A1 | 9/2003 | Berger et al. | |
| 2004/0182468 | A1 | 9/2004 | Trondle et al. | |
| 2005/0161919 | A1 | 7/2005 | Berger et al. | |

FOREIGN PATENT DOCUMENTS

| | | |
|---|---|---|
| DE | 42 23 953 | 1/1994 |
| FR | 2 669 651 | 5/1992 |
| GB | 2 051 149 | 1/1980 |
| WO | WO 99/14409 | 3/1999 |

* cited by examiner

METHOD FOR PRODUCING A WOVEN AND A HEDDLE PARTICULARLY FOR USE THEREBY

CROSS REFERENCE TO RELATED APPLICATIONS

This application is a continuation of PCT/EP2004/001764, filed Feb. 23, 2004, which claims priority to German Application No. 103 09 260.9, filed Mar. 3, 2003, both of which are incorporated by reference herein.

BACKGROUND AND SUMMARY OF THE INVENTION

The present invention relates to a method for producing a woven on a loom comprising a stop bar, at least one shed and a heddle (heald) particularly for use thereby.

On modern narrow fabric needle looms tapes are produced preferably with a crossed tie of warp and weft in known weaves (1High-1Low, 2H-2L, 1H-3L, 3H-1L, 2H-4L, 4H-2L, 4H-4L, 2H-6L, 6F-2L etc.). Controlling the threads in this way is achieved by inserting the threads into the heddle eyelets (mails), lined up on shafts having these special motions. To figure or letter such tapes as produced with a normal weave, warp threads for producing the product are inserted fully or partly in heddle eyelets knotted to coarse threads connected to lifters of a Jacquard loom.

By the associated possibility of controlling the long repeats individually programmed, the regular weave repeats, contrary to the above, coming from the shaft control can be flexible interrupted so that figures, emblems or contours are produced functionally or in the visual appearance by the contrasts between warp and weft material with weave interrupts or floating extensions. As a rule, woven tapes are produced in this way on modern narrow woven needle looms double-picked weft for weft. To render wovens elastic, additional elastic threads (bare or wrapped) can be worked in which, for example, in a 1H-1L weave result in even and uneven wefts becoming facing and backing wefts respectively. This is because the weft threads come to rest below and above in up and down motion of the elastic thread respectively.

For more rational production of such tapes it is known to double tape output by simultaneously picking the facing and backing weft thread (for example by means of a double needle technique). This is achieved by forming a double shed by separating the upper thread position from the lower thread position in the middle mainly by elastic warp threads. Rationalizing tape production in this way in combination with jacquarding necessitates Jacquard looms capable of producing three-point shedding per heddle by making use of two control elements. However, the programming needed for this is correspondingly complicated.

On modern wide looms individual warp thread control is applied, likewise with the aid of Jacquard looms, to produce wovens with figures, emblems or contours. For this purpose the weft threads are picked to also permit the formation of two-ply wovens, where necessary, by, for example, the uneven picks forming more the backing layer and the even picks forming more the facing layer, or vice-versa. Interrupting the thread motion, producing the two-ply woven, by a thread motion which produces a link between facing and backing woven permits contouring as desired. Existing methods and devices employed therefor are no longer sufficiently suitable to produce the required woven quantity per unit of time or are too complicated and expensive. Apart from this, the Jacquard looms employed in known methods are subjected to extremely high loading and wear out correspondingly prematurely.

The invention is based on the objective of proposing a method for producing a woven and a heddle (heald) particularly for use thereby whilst avoiding, or at least greatly reducing, the disadvantages known with prior art. This objective is achieved by a method as it reads from claim 1 and by a heddle (heald) as it reads from claim 4. The advantages of the method in accordance with the invention and of the heddle as employed thereby can be described as follows. This method now makes it possible to double output by employing to advantage a double pick technique (picking two superposed wefts simultaneously) in creating with normal halved basic weave placement (1H-1L from 2H-2L and 2H-2L from 4H-4L, etc) high/low shedding shaft-controlled by (for example as with elastic tapes) middle positioning the (elastic) threads located in the middle shed by interrupting the motion of normal keying threads as needed for figuring the woven by halting the motion despite the full shaft stroke. Halting the motion is attained by one end of the slotted heddle controlled up/down by a corresponding normal Jacquard heddle motion, the warp thread guided in the slotted heddle being unable to move beyond the middle position.

In the method in accordance with the invention the warp threads having the function of producing a figure, emblem and/or contour are inserted not only into ordinary heddles but in addition also into heddles in accordance with the invention having a slotted eyelet (elongated mail). At the locations at which no figure point is needed the corresponding slotted heddle is positioned for example down [up] in which the slot is no obstruction to the threads which are moved up/down by a normal shaft motion with ordinary heddles, because of the slot position. Controlling the slotted heddle up [down] by a normal control pulse and tying in the slotted heddle so that the lower [upper] end of the slot is located in the middle or middle shed position halts the greater warp thread motion—produced by the ordinary heddles—in the middle or middle shed position and prevents it from implementing a normal weave pattern in thus making it possible to produce in each case a figure point (for example, a warp or weft portion visible outside a woven ply) in the normally programmable long repeat. The big advantage afforded by this is that although the programming is normally done on machines which implement only up/down control, double-shedding is now achievable by this approach in thus producing the woven twice as fast than in existing prior art methods. It is to be noted that the square bracketed [ ] positions above are intended to replace the positions directly indicated before when a heddle working in the opposite direction is meant.

Further huge advantages materialize when using the method in accordance with the invention and the heddle as employed therein on wide looms. In this arrangement, when using machines for example featuring double, simultaneous picking, e.g. double grip looms, through weaves can be alternated with hollow weaves by the threads weaving for example 1H-1L from the shaft motion being prevented from implementing their full motion individually with correct tie-in with (upper or lower) end of the slot in the middle shed when additionally drawn in the slotted heddle on Jacquard loom control. Alternating up/down or vice-versa down/up of each individual slotted heddle as controllable individually by the Jacquard loom over the full width of the woven in halting the full motion of the warp thread in accordance with the shaft motion in the middle shed enables figures or functional contours to be produced. Applying the method in accordance with the invention and the slotted heddle in accordance with the invention doubles output for the same loom speed and with a corresponding desired woven structure coupled with the advantage of an enormous reduction in the motion intensity of the Jacquard loom adding to its life.

BRIEF DESCRIPTION OF THE DRAWINGS

For a better understanding the invention will now be detained with the aid of a drawing showing the various positions of the ordinary heddles and slotted heddles, in which.

DETAILED DESCRIPTION

Figure 1:
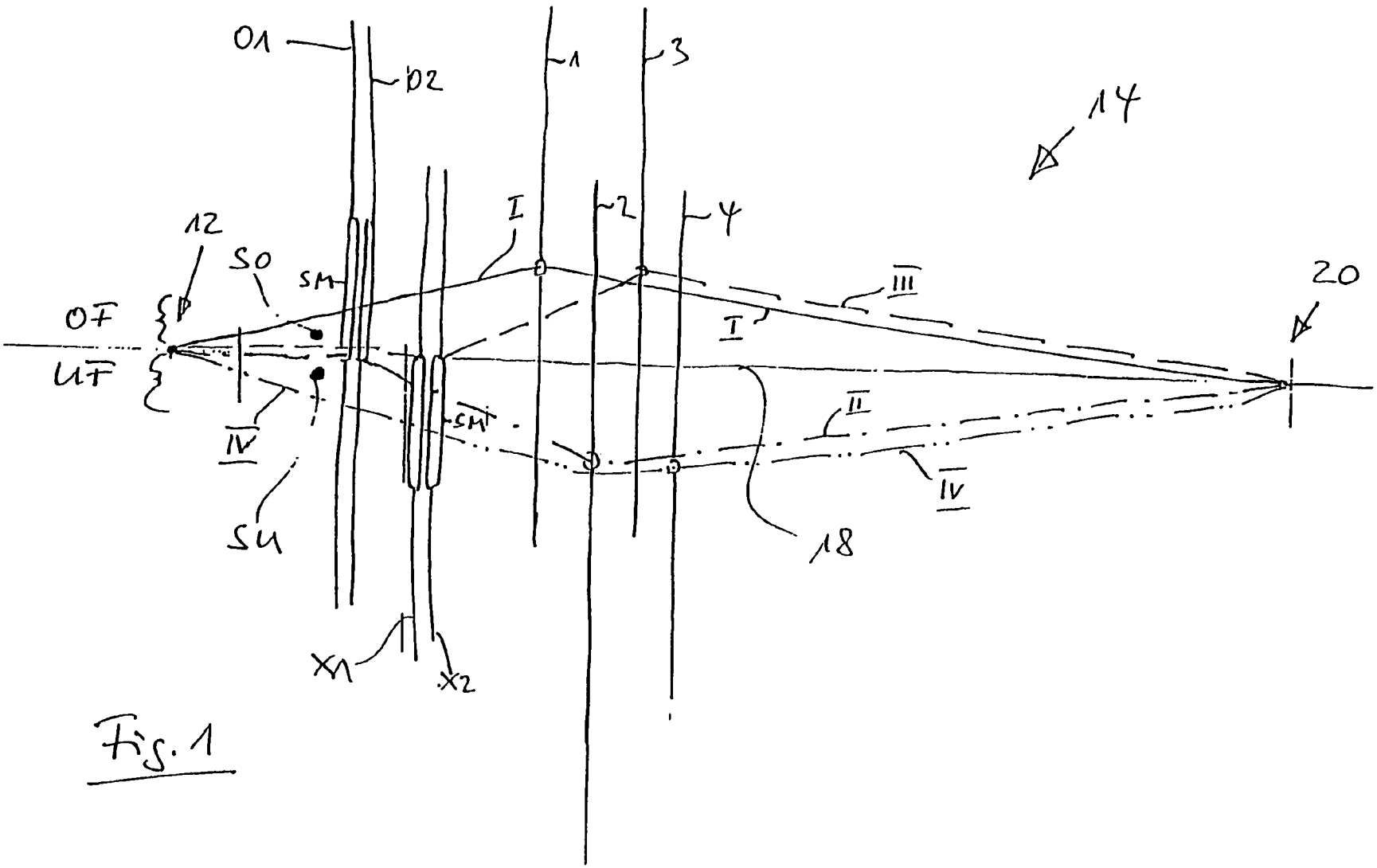
FIG. 1 is a greatly simplified diagrammatic illustration, slightly distorted to the sides, of the arrangement of four ordinary heddles for four warp threads assigned four slotted heddles in the position in which a two-ply woven is produced.

Referring now to FIG. 1 there is illustrated greatly simplified the diagrammatic arrangement of the shedding and "materialization" region of a loom 14 in which between a stop bar 12 and a warp creel 20 two pairs of ordinary heddles 1, 2 and 3, 4 are shown through which the warp threads I, II and III, IV pass. The warp threads I, II are guided by each slotted eyelet 16 of slotted heddle O1, O2 and X1, X2 arranged between ordinary heddles and stop bar. The ordinary heddles which in reality are arranged one behind the other as viewed in the direction passing through the drawing vertically are shown juxtaposed in FIGS. 1 to 4 to visualize the run of the warp threads guided through each of them; the same applying to the slotted heddle pairs O1, O2 and X1, X2 shown to the left thereof in the FIGS. 1 to 4. Depicted stylized in the area between the slotted heddle O1 shown on the left of FIG. are the facing weft SO and backing weft SU above and below the middle shed line middle shed line 18 respectively. The double pick comprising the facing weft SO and backing weft SU is entered into the upper shed (facing weft SO) formed by the warp threads I and II and simultaneously into the lower shed (backing weft SU) formed by the warp threads III and IV in a direction passing substantially perpendicular through the plane of drawing, whereby the warp threads I and II together with the facing weft SO form a facing ply OL and the warp threads III and IV together with the backing weft SU form a backing ply UL of a two-ply woven with the four warp threads representing the smallest repeat of a multi-thread.

The first ordinary heddle 1 raises the first warp thread I to its uppermost position whilst the second ordinary heddle 2 lowers the warp thread II to its lowest position. The warp thread II is, however, unable to gain access below the middle shed line middle shed line 18 because of being prevented by the slotted eyelet 16 of the slotted heddle O1, resulting in the backing weft SU being automatically entered below the warp thread II.

Figure 2:
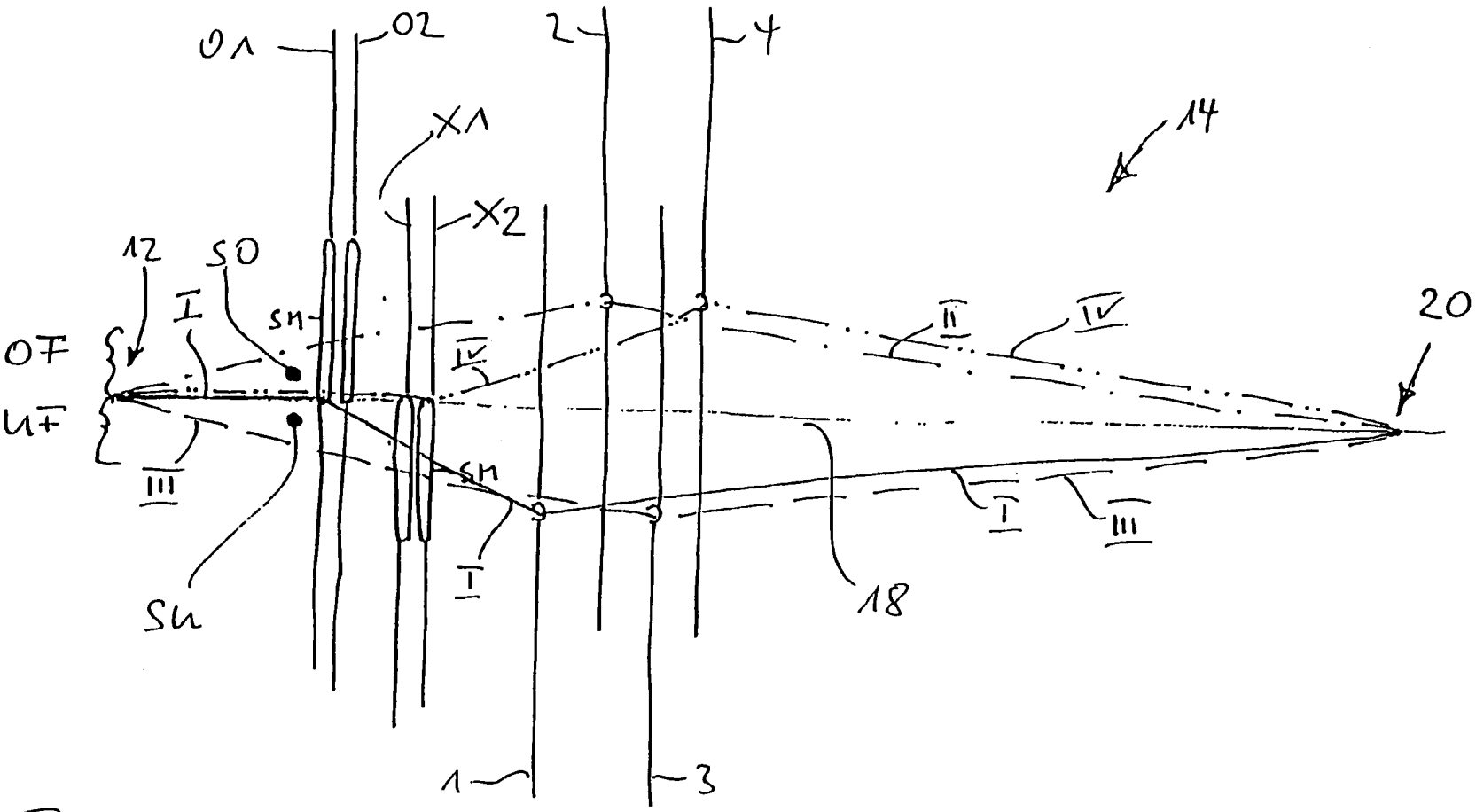
FIG. 2 is an illustration analogous to that of FIG. 1 showing the positioning of the heddles, but working out of step, at the material forming location of a loom.

Referring now to FIG. 2 there is illustrated how the upper shed OF formed by the warp threads I and II is similar analogous to the upper shed as shown in FIG. 1. The slotted heddles 1 and 2 as shown in FIG. 2 are out of step with the arrangement as shown in FIG. 1 so that the warp thread II is raised most and warp thread I is lowered most, it being obvious from FIG. 2 that because of the slotted heddle O2 any motion of the warp threads I between the location of the slotted heddle O2 and the stop bar 12 below the middle shed line is prevented. In this case too, the facing weft SO is entered only in the shed formed by warp threads I and II.

The slotted heddles X1 and X2 as shown in FIGS. 1 and 2 are depicted in their lowest position so that the slotted eyelet 16 machined therein permits motion of a warp thread III and IV guided therethrough upwards only as far as middle shed line 18. Because of this arrangement the lower shed UF between the stop bar and the slotted heddles X1 and X2 is penetrated only by the lower weft thread. The arrangement of the ordinary heddles 3 and 4 is illustrated analogous to the arrangements of the ordinary heddles 1 and 2 (as shown in FIGS. 1 and 2).

FIGS. 1 and 2 illustrate production of a two-ply woven, the facing woven comprising the warp threads I and II and the backing woven the warp threads III and IV. The slotted heddles O1 and O2 work slot middle SM down>up (raising) and the slotted heddles X1 and X2 work slot middle SM up>down (lowering). Raising the slotted heddles O1 and O2 means that the warp threads I, II are prevented from being lowered into the lower shed UF. Lowering the slotted heddles X1 and X2 means that the warp threads III, IV are prevented from being raised into the upper shed OF.

Figure 3:
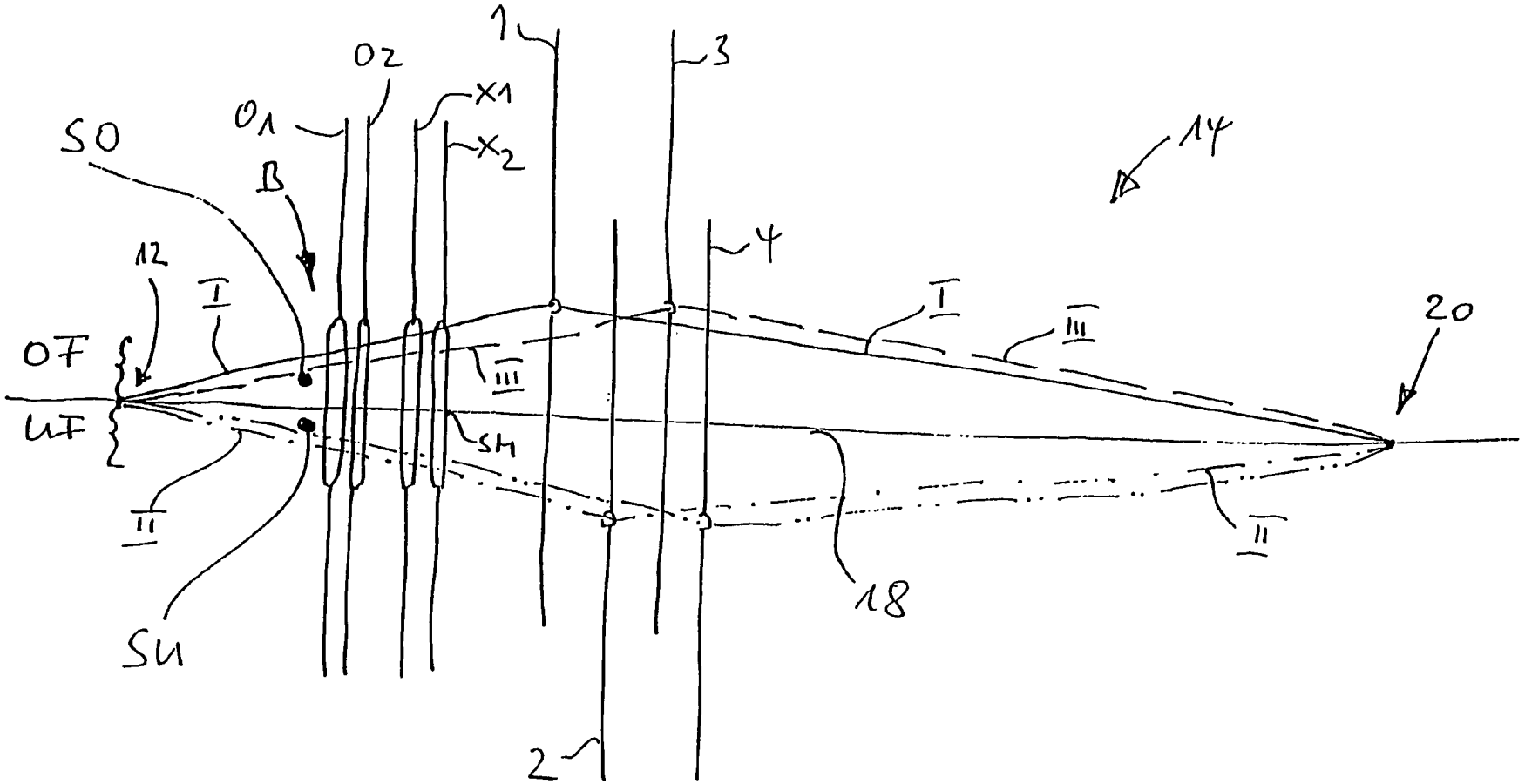
FIG. 3 is a greatly simplified diagrammatic illustration, slightly distorted to the sides, of the arrangement of four ordinary heddles for four warp threads assigned four slotted heddles in the position in which a single-ply woven is produced.
Figure 4:
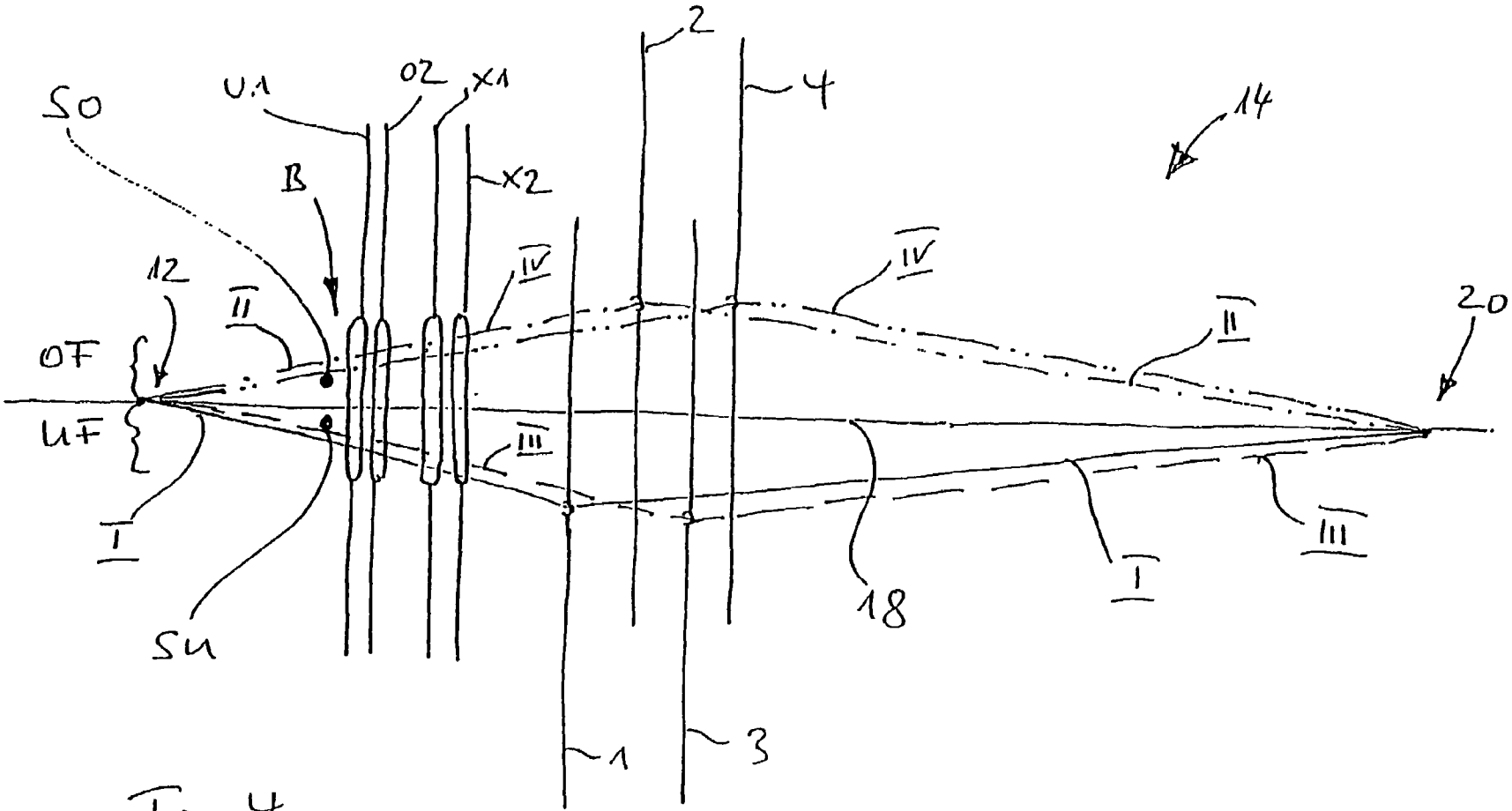
FIG. 4 is an illustration analogous to that of FIG. 1 showing the positioning of the heddles, but the heddles working out of step, at the material forming location of a loom.

Referring now to FIGS. 3 and 4 there are illustrated the heddles 1, 2, 3 and 4 in the positions analogous to those as shown in FIGS. 1 and 2, resulting in the warp threads I to IV being guided up/down by the heddles 1 to 4. However, to produce a single-ply woven all slotted heddles are fully raised/lowered accordingly, the slotted heddles O1 and O2 then being in the lowest position so that their slot middles SM (centerlines of the slots, see FIG. 5) are level with the middle shed line 18 and both warp threads I and II are then able to fully implement the motions of the heddles 1 and 2 without being obstructed by the slotted heddles O1 and O2. The slotted heddles X1 and X2 then being in the fully raised position so that their slot middles SM also are level with the middle shed line 18 and both warp threads III and IV are then able to fully implement the motions of the heddles 3 and 4 without being obstructed by the slotted heddles X1 and X2. In other words the wefts OL and UL are entered in the "full" shed taking up the space of aforementioned partial sheds OF and UF. As a result, a single-ply woven is produced with a double pick, in other words twice as fast precisely the same as the two-ply woven simultaneously produced as described before.

Figure 5:
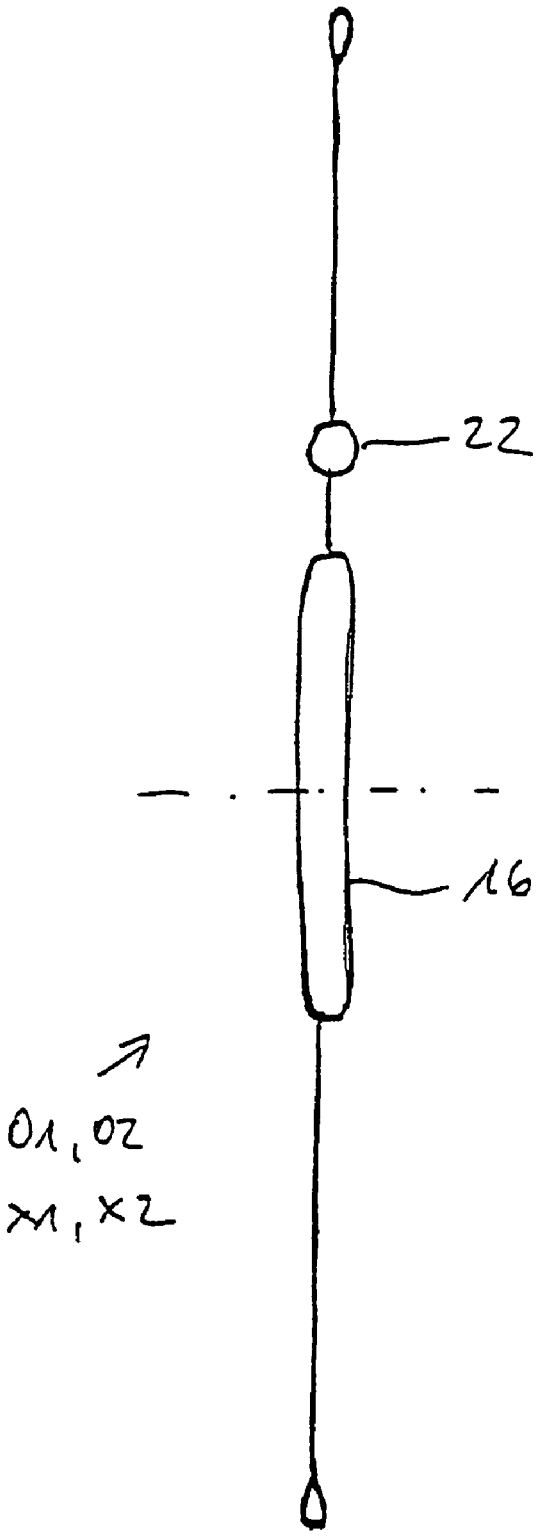
FIG. 5 is a greatly simplified diagrammatic illustration of a slotted heddle in accordance with the invention.

Referring now to FIG. 4 there are illustrated the positions of the first heddles 1 to 4 and thus the run of the warp threads I to IV out of step to that as shown in FIG. 3. Referring now to FIG. 5 there is illustrated by way of example (not true to scale) a slotted heddle O1 having a slotted eyelet 16 which in accordance with an advantageous further embodiment may also comprise an additional regular eyelet 22.

It will be appreciated that there are no limits to the range of applications of the method in accordance with the invention and the slotted heddles in accordance with the invention for producing all kinds of single and two-ply wovens, particularly tailored tubular wovens.

The invention claimed is:

1. A method for producing a woven on a loom comprising:

providing a stop bar and at least one shed;

at least one ordinary heddle guiding a warp thread for cooperating with a slotted heddle assigned thereto between said ordinary heddle and the stop bar of the loom;

passing said warp thread through said ordinary heddle and said assigned slotted heddle;

controlling said slotted heddle by a Jacquard device which implements heddle motion; and simultaneously picking two superposed wefts, one arranged above and one below shed center;

producing a weft portion visible outside a woven ply during said motion of said ordinary heddle, displacing said slotted heddle in a first position by said Jacquard device;

preventing said warp thread, guided by said ordinary heddle, from further moving beyond said shed center by use of an elongated eyelet of the slotted heddle; and picking one of said two wefts outside of said shed.

2. The method as set forth in claim 1 further comprising guiding a second warn thread by at least one second ordinary heddle for cooperating with a second slotted heddle assigned between said second ordinary heddle and said stop bar of said loom, said second ordinary heddle and said second slotted heddle working out of step to said first ordinary heddle and said first slotted heddle.

3. The method as set forth in claim 1 for producing a partly multi-ply woven wherein:

providing a first and second of said ordinary heddles;

providing said first slotted heddle and a second slotted heddle;

passing said warp threads through said ordinary heddles and said assigned slotted heddles;

controlling said slotted heddles by said Jacquard device which implements normal heddle up/down motion;

picking two superposed wefts, one arranged above and one below shed center, in the shed divided into an upper and a lower shed;

producing a facing ply during down motion of said first ordinary heddles, displacing said first slotted heddles in an up position by said Jacquard device;

providing said first slotted heddles with elongated eyelets whose lower ends are then in the center of said shed;

preventing said warp threads, guided by said first ordinary heddles and responsible for said facing ply, from moving downward beyond said shed center; and picking the lower of the two wefts outside of said upper shed;

producing a backing woven ply;

displacing said second slotted heddles in a down position by said Jacquard device during up motion of said second ordinary heddles;

providing said second slotted heddles with elongated eyelets whose upper ends are then in the center of said shed;

preventing said warp threads, guided by said second ordinary heddles and responsible for said backing layer, from moving upward beyond said lower shed; and picking the upper of the two wefts outside of said lower shed.

4. A loom comprising:

a stop bar;

at least one shed;

a Jacquard device;

a warp thread; and at least one heddle guiding the warp thread co-operating with a slotted heddle assigned thereto between said heddle and said stop bar of said loom;

said warp thread passing through said heddle and said assigned slotted heddle;

said slotted heddle being controllable by said Jacquard device which implements heddle motion; and said slotted heddle is displaceable by said Jacquard device to produce a visible weft portion above a woven layer during said heddle movement.

* * * * *